United States Patent [19]

Bro

[11] Patent Number: 5,076,520

[45] Date of Patent: Dec. 31, 1991

[54] INFANT TOY SUPPORT

[75] Inventor: Jay M. Bro, Long Beach, Calif.

[73] Assignee: Mattel, Inc., El Segundo, Calif.

[21] Appl. No.: 503,006

[22] Filed: Apr. 2, 1990

[51] Int. Cl.[5] ..... F16M 11/24

[52] U.S. Cl. ..... 248/165; 5/508; 446/227

[58] Field of Search ..... 248/105, 106, 165, 166; 5/508, 93 R; 446/227

[56] References Cited

U.S. PATENT DOCUMENTS

| | | | |
|---|---|---|---|
| 2,924,414 | 2/1960 | Tesdal | 248/165 |
| 3,085,610 | 4/1963 | Vardan . | |
| 3,222,020 | 12/1965 | Rea . | |
| 3,476,348 | 11/1969 | Rustad | 5/508 |
| 3,699,704 | 10/1972 | Hakim . | |
| 3,978,610 | 9/1976 | Stubbmann . | |
| 4,147,344 | 4/1979 | Lee . | |
| 4,169,591 | 10/1979 | Douglas | 5/508 |
| 4,188,745 | 2/1980 | Harvey et al. . | |
| 4,335,538 | 6/1982 | Greenberg . | |
| 4,410,158 | 10/1983 | Maffei | 5/508 |
| 4,561,549 | 12/1985 | Yokohori . | |
| 4,627,588 | 12/1986 | Block . | |
| 4,664,640 | 5/1987 | Shindo et al. . | |
| 4,702,719 | 10/1987 | Lapid . | |
| 4,854,531 | 8/1989 | Esposito | 248/165 |
| 4,932,090 | 6/1990 | Johansson | 5/508 |
| 4,934,638 | 6/1990 | Davis | 248/166 X |

FOREIGN PATENT DOCUMENTS

| | | | |
|---|---|---|---|
| 565854 | 8/1957 | Italy | 248/165 |

*Primary Examiner*—Gary L. Smith
*Assistant Examiner*—Michael J. Milano
*Attorney, Agent, or Firm*—Roy A. Ekstrand

[57] ABSTRACT

An infant toy support includes a cross member having a pair of angular leg members pivotally attached to each end thereof. A lock mechanism is provided for each of the leg members which permits the height of the cross member to be adjusted between several height positions. Additionally, the lock member provides for the pivotal folding of the toy support structure to a collapsed more compact configuration for storage and transport. Angled members are provided for each leg member to further captivate the infant beneath the cross member. A plurality of straps extend downwardly from the cross member to suspend toy articles above the infant.

6 Claims, 2 Drawing Sheets

INFANT TOY SUPPORT

FIELD OF THE INVENTION

This invention relates generally to infant toys and particularly for support means used to suspend a variety of infant toys above an infant.

BACKGROUND OF THE INVENTION

During the course of infant care, it is often desirable to place the infant on an extended flat surface such as a room floor and allow the infant to rest upon the floor without danger of falling or encountering dangerous objects. Through the years, a number of devices have been provided which permit those caring for such infants to support a plurality of amusement, entertainment and educational or developmental devices above or near the infant. When successfully used, such apparatus contribute to child development and permit the infant to be amused and occupied for extended periods of time. In providing such apparatus, two major criteria or objectives have directed practitioners in the art in developing various types of devices. The first and foremost requires that the safety of the infant be maximized and that the apparatus not place the infant in any potential danger of injury. The second criteria seeks to maximize the entertainment value of the apparatus in order to more easily occupy the infant for extended periods of time.

The need for such apparatus has prompted practitioners in the art to develop a variety of support apparatus for infant toys. One such apparatus is set forth in U.S. Pat. No. 4,561,549 issued to Yokohori which sets forth an APPARATUS FOR SUPPORTING BABY TOYS in which a tubular support structure includes upwardly extending bars to which oblique bars are pivotally connected. A connecting bar extends between the oblique bars to support baby toys. The elevation of the connecting bar above the base is adjustable by pivoting the oblique bars relative to the base.

U.S. Pat. No. 4,702,719 issued to Lapid sets forth a DEVICE FOR SUSPENDING INFANT TOYS in which a suspension bar structure is adapted to be supported in a horizontal position during use for suspending a plurality of toys therefrom. A pair of supporting bars are disposed on opposite ends of the suspension bar and a pair of juncture bars join the supporting bars on opposite ends thereof in a common plane to provide an angled support for infant toys. A plurality of joints interposed between each of the bar members permits the entire structure to be folded such that the bar members are arranged in a parallel group for storage and transport. An alternate embodiment sets forth a pair of angled members having a cross member connected therebetween for supporting the toy bars. The angled members are pivotal with respect to the cross member to permit the structure to be folded into a single plane for storage and transport.

U.S. Pat. No. 3,222,020 issued to Rea sets forth an APPARATUS FOR HOLDING NURSING BOTTLES in which a pair of angled members are joined to a horizontal member to form a support structure in which the horizontal member is positioned above the infant. A pivotal junction sleeve is rotatably coupled to the horizontal cross member and includes a clamp for supporting a nursing bottle in a variety of adjustable angular positions.

U.S. Pat. No. 4,627,588 issued to Block sets forth an INFANT ARTICLE SUSPENSION STRUCTURE in which a support structure for suspending a plurality of interchangeable infant toys includes a bridge structure supported in an elevated position by a quartet of downwardly extending support members. The support structure forms a bridge element over the infant and includes a plurality of articulated joint members for varying the suspension position of the toys.

U.S. Pat. No. 4,188,745 issued to Harvey et al. sets forth an INFANT TOY for mounting upon or connecting to an infant seat, car seat, infant bed, stroller or the like. The structure comprises a generally U-shaped inverted member having a support plane connecting the downwardly extending side members. The side members further include adjustable clamping pads for engaging the infant seat or the like and securing the support thereto. A plurality of toy devices are suspended from the upper cross member to provide entertainment for the infant.

In addition to the foregoing described support apparatus, a plurality of related and somewhat similar structures have been provided by practitioners in the art for supporting infant amusement devices and toys in connection with infant cribs or beds. U.S. Pat. No. 3,789,610 and U.S. Pat. No. 4,664,640 set forth representative structures of such devices in which arcing members are secured to the crib sides and support suspended toys therefrom. U.S. Pat. No. 4,147,344, U.S. Pat. No. 4,335,538, U.S. Pat. No. 3,085,610 and U.S. Pat. No. 3,699,704 set forth generally related structures for supporting infant toys.

While the foregoing described structures have provided more or less satisfactory apparatus for supporting infant toys and amusement devices, there remains a continuing need in the art for support apparatus which further enhance the safety of the infant and which provide increased levels of activity and amusement for occupying and developing the infant.

SUMMARY OF THE INVENTION

Accordingly, it is a general object of the present invention to provide an improved infant toy support. It is a more particular object of the present invention to provide an improved infant toy support which produces a safer and more entertaining environment for the infant. It is a still more particular object of the present invention to provide an improved toy support providing greater safety and entertainment which accommodates a variety of height positions and which may easily be stored or transported.

In accordance with the present invention, there is provided for use in supporting a plurality of infant toy articles above an infant, an infant toy support comprising; an elongated cross member having first and second ends; a plurality of infant toy attachment means secured to the cross member; a first leg member having a first base member and a first angled bar joined thereto forming an acute angle therebetween; a second leg member having a second base member and a second angled bar joined thereto forming an acute angle therebetween; first and second lock means securing the first and second leg members to the first and second ends of the cross member in an adjustable attachment in which the first and second leg members are detentably positionable with respect to the cross member in a plurality of angular and spacial positions.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
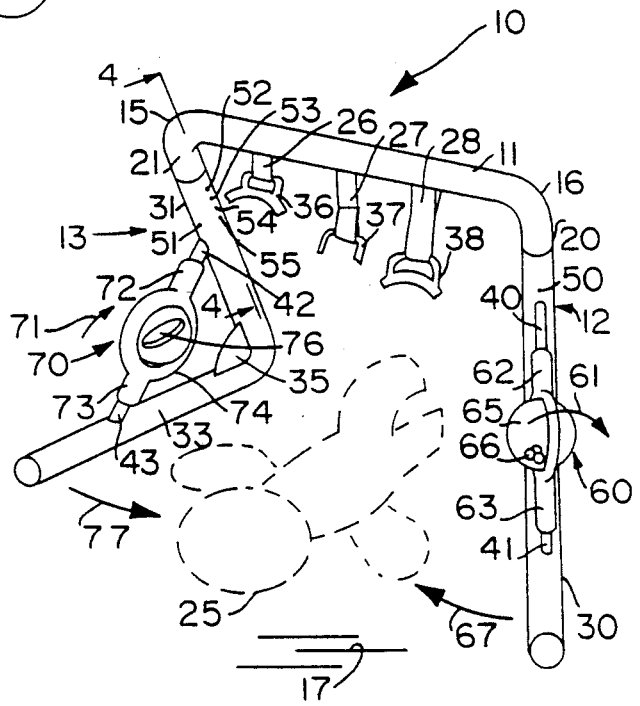
FIG. 1 is a perspective view of the present invention infant toy support in combination with a typically positioned infant.

FIG. 1 sets forth a perspective view of the present invention infant toy support generally referenced by numeral 10. Toy support 10 includes a horizontal cross member 11 having a generally cylindrical cross section and formed into a pair of right angle bend portions 15 and 16. A pair of generally cylindrical junction bars 20 and 21 extend downwardly from bend portions 16 and 15 respectively. A plurality of suspension straps 26, 27 and 28 are secured to cross member 11 in a generally equally spaced arrangement and extend downwardly therefrom. Straps 26, 27 and 28 support a corresponding plurality of toy articles 36, 37 and 38 as is better seen in FIG. 2. A pair of leg members 12 and 13 are joined to cross member 11 by means set forth below in greater detail and provide support therefor. Leg member 12 includes a generally cylindrical angled bar 30 defining a plurality of apertures such as aperture 50, the function of which is set forth below in greater detail, and a base member 32. Base member 32 may be formed in any number of cross sectional shapes, however, it has been found advantageous to form base member 32 in a generally cylindrical shape. Base member 32 is joined to angled bar 30 in an angled joint as is better seen in FIG. 2. A reinforcing web 34 (better seen in FIG. 2) reinforces the junction of angled bar 30 and cross member 32. A pair of angled boss members 40 and 41 extend inwardly from angled bar 30 and base member 32 respectively in a coaxial alignment.

An angled support 60 includes a ring member 64 having a pair of outwardly extending generally cylindrical sleeve members 62 and 63. In accordance with the invention, sleeve members 62 and 63 are coaxially aligned and are received upon angled bosses 40 and 41 respectively to secure angled support 60 between angled bar 30 and base member 32. A hollow spherical ball 65 is supported within the interior of ring 64 in a rotatable attachment whereby ball 65 may be rotated in the directions indicated by arrows 61. While ball 65 may be formed from any number of materials, in its preferred form, ball 65 is formed from a transparent plastic material and supports a plurality of rattle objects 66 within its interior. To enhance the amusement value of angled support 60, rattles 66 are generally selected to provide a variety of colored objects which freely move within the interior of ball 65.

Figure 2:
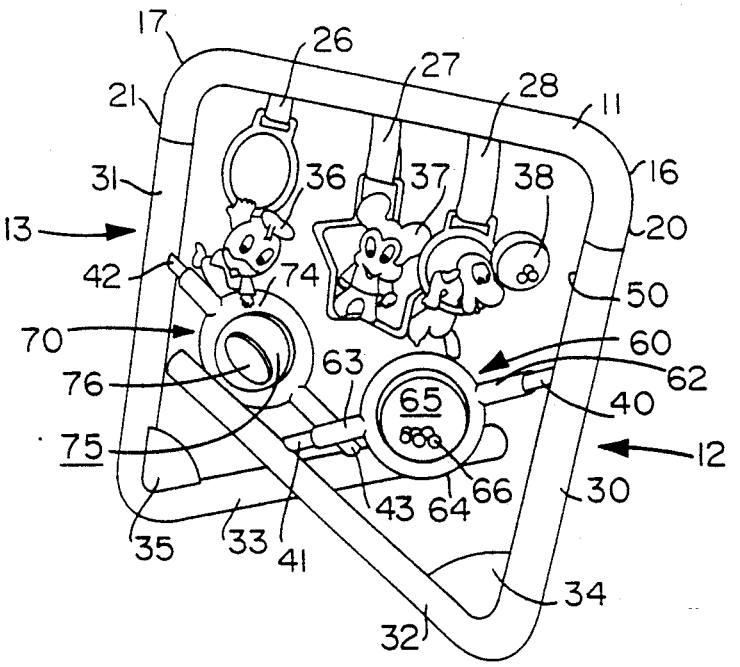
FIG. 2 is a perspective view of the present invention infant toy support in its folded or storage position.

Leg member 13 is constructed in accordance with leg member 12 and, as is seen in FIGS. 1 and 2, forms a mirror image object thereof. Accordingly, leg member 13 includes an angled bar 31 having a cylindrical cross section and defining a plurality of apertures 51 through 55 therein. Leg member 13 further includes a generally cylindrical base member 33 joined to angled bar 31 in an angular attachment. A reinforcing web 35 extends between angled bar 31 and base member 33 to reinforce the angular joint therebetween. In further similarity to leg member 12, leg member 13 includes a pair of generally cylindrical angled bosses 42 and 43 extending inwardly from angled bar member 31 and base member 33. In further accordance with the above-described structure of leg member 12, angled bosses 42 and 43 are coaxially aligned.

An angled support 70 similar in structure to angled support 60 defines a ring member 74 having a pair of outwardly extending generally cylindrical sleeve members 72 and 73. Sleeve 72 is received upon cylindrical boss 42 while sleeve 73 is received upon angled boss 43. The attachment between sleeves 72 and 73 and angled bosses 42 and 43 respectively secures angled support 70 between angled bar 31 and base member 33 in the position shown in FIGS. 1 and 2. A generally spherical hollow ball member 75 is supported in a pivotal attachment within the interior of ring 74 and is thus rotatable in the directions indicated by arrows 71. A rattle article 76 is captivated within the interior of ball 75 and is freely movable therein to provide a rattling action when ball 75 is rotated within ring 74.

As mentioned above, leg members 12 and 13 are mirror image objects of each other. Accordingly, it should be understood that while not seen in FIGS. 1 and 2 due to the perspective views therein, leg member 12 defines a plurality of inwardly directed apertures in angled bar 30 in mirror image correspondence to apertures 52 through 55 of angled bar member 31 of leg member 13. In accordance with an important aspect of the present invention and by means set forth below in greater detail, leg members 12 and 13 are pivotally secured to junction bars 20 and 21 respectively and thus are alternatively positionable between the extended positions shown in FIG. 1 and the folded positions shown in FIG. 2. Thus, leg members 12 and 13 are pivotable in the directions indicated by arrows 67 and 77 respectively from the extended position shown in FIG. 1 to the closed position shown in FIG. 2. In addition and in accordance with an important aspect of the present invention, cross member 11 may be raised with respect to leg members 12 and 13 by extension of the attachment between junction bars 20 and 21 and angled bars 30 and 31 in the directions indicated by arrows 68 and 78. Accordingly, the raised positioning of cross member 11 raises toy articles 36 through 38 and thus adjusts the height thereof.

In accordance with its intended use, base members 32 and 33 rest upon a typical surface 17 such as a room floor and are positioned on either side of an infant 25. Infant 25 may alternatively be resting upon floor surface 17 directly or may be supported within a typical infant seat of the type well known in the art or upon a suitable pad or other article. In either event, the height of cross member 11 may be adjusted by the means set forth below in greater detail to suspend toy articles 36 through 38 above infant 25 at the desired height to suit the infant's activity and reach. In accordance with a further advantage of the present invention structure, the positioning of angled supports 60 and 70 provides further entertainment environment for infant 25 in that the amusement provided by rotation of ball members 65 and 75 to activate rattles 66 and 76 respectively. While the functions of angled supports 60 and 70 provide enhanced entertainment for infant 25, they function to provide a further enhancement of the environment for infant 25 in that they reinforce the support of cross member 11 and increase the enclosure of infant 25 between leg members 12 and 13. But for the placement of angled supports 60 and 70, infant 25 would be free to move across base members 32 and 33 and possibly undertake movements tending to tip infant toy support 10 or other potentially injurious activity.

FIG. 2 sets forth a perspective view of infant toy support 10 in its folded position. As mentioned above, the folded position of FIG. 2 is obtained by pivoting leg members 12 and 13 about junction bars 20 and 21 respectively.

As set forth above, infant toy support 10 includes a generally cylindrical cross member 11 having a pair of right angled bend portions 16 and 17 on either end thereof. A pair of generally cylindrical junction bar members 20 and 21, the structure of which is set forth below in greater detail, extend from bend portions 16 and 17 respectively. A pair of leg members 12 and 13 are secured to junction bars 20 and 21 by means set forth below in greater detail. Cross member 11 supports a plurality of suspension straps 26 through 28 extending downwardly therefrom. A corresponding plurality of toy devices 36 through 38 are secured to straps 26 through 28 respectively.

Leg member 12 includes a generally cylindrical angled bar 30 and a base member 32 joined in an angled joint which is reinforced by a web 34. Angled bar 30 defines a cylindrical angled boss 40 while base member 32 defines a generally cylindrical angled boss 41. An angled support 60 includes a ring member 64 having a pair of outwardly extending generally cylindrical sleeves 62 and 63. Sleeves 62 and 63 are received upon angled bosses 40 and 41 respectively to support angled support 60 between angled bar 30 and base member 32. A transparent hollow ball 65 is pivotally supported within ring member 64 and supports a plurality of rattle articles 66 within its interior.

Similarly, leg member 13 includes an angled bar 31 and a base member 33 joined at a junction which is reinforced by web member 35. A pair of angled bosses 42 and 43 extend inwardly from angled bar 31 and base member 33 respectively and are received within a pair of sleeve members 72 and 73 of angled support 70. A ring member 74 of angled support 70 is joined to sleeve members 72 and 73 and supports a transparent hollow ball 75 in a pivotal attachment. A colorful rattle member 76 is captivated within ball 75. Angled bar 31 defines an aperture 51 while angled bar 30 defines a corresponding aperture 50 (better seen in FIG. 1). In accordance with the structure set forth below in greater detail, leg member 13 is maintained in the folded position shown in FIG. 2 by the extension of a lock button 80 through aperture 51. While not seen in FIG. 2, it should be understood that a similar structure is operative upon leg member 12 to maintain leg member 12 in the folded position shown in FIG. 2. Thus, it will be apparent to those skilled in the art that the present invention infant toy support may readily be foldable into a compact structure shown in FIG. 2 for carrying or storage and may be extended to the support position shown in FIG. 1 to provide the above-described support for toy articles 36 through 38. It should be further noted that the placement of apertures 50 and 51 upon leg members 12 and 13 respectively is selected to maintain cross member 11 in its lowest position with respect to leg members 12 and 13 to assure that the most compact arrangement is obtained for the storage and transport position of the present invention infant toy support.

Figure 3:
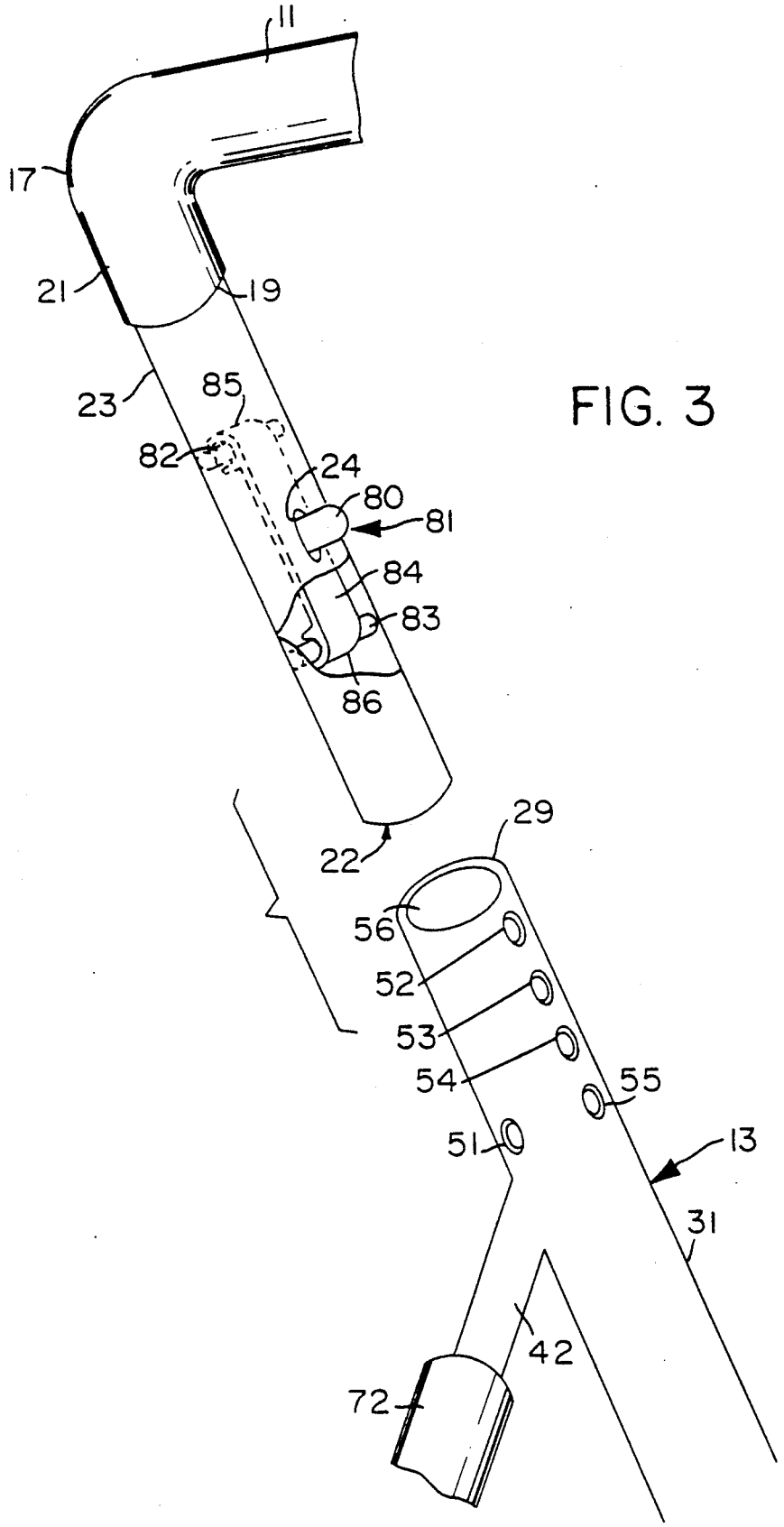
FIG. 3 sets forth an assembly view of a portion of the present invention infant toy support.

FIG. 3 sets forth an assembly view of the attachment of cross member 11 to leg member 13. At the outset, it should be understood that a corresponding attachment is provided between cross member 11 and leg member 12. Thus the descriptions which follow in connection with FIG. 3 should be understood to apply equally well to the structure which secures cross member 11 to leg member 12. As described above, cross member 11 includes a bend portion 17 and a junction bar 21 extending downwardly therefrom. Junction bar 21 further includes a reduced diameter cylindrical extension 23 and a raised lip portion 19. Extension 23 comprises a hollow cylindrical extension defining an interior passage 22 and an aperture 24 therein. A pair of generally cylindrical boss members 82 and 83 extend transversely within interior 22 and are generally equally spaced from aperture 24. A lock member preferably formed of a resilient material includes a button support member 84 having a generally elongated planar shape and a pair of clasp members 85 and 86 on either end thereof. Clasp members 85 and 86 are configured to attach to boss members 82 and 83 respectively in a snap attachment which secures lock member 11 within interior 22. A generally cylindrical lock button 80 extends upwardly from button support 84 and passes through aperture 24 of extension 23. The extending dimension of lock button 80 is selected to assure that lock button 80 passes through aperture 24 and extends beyond the outer surface of extension 23.

Leg member 13 includes a generally cylindrical angled bar 31 defining a cylindrical internal passage 56 therein. Angled bar 31 further defines an upper edge 29 and a plurality of apertures 52 through 55 arranged in a common alignment near edge 29. Angled bar 31, as described above, further defines an angled boss 42 which receives and supports sleeve 72 of angled member 70. In addition, angled bar 31 defines an aperture 51 positioned approximately the same distance from edge 29 as aperture 55 but angular displaced therefrom by approximately ninety degrees.

In accordance with the invention, cross member 11 is secured to leg member 13 by inserting extension 23 into internal passage 56 of angled bar 31. As extension 23 is moved downwardly within internal passage 56, leg member 13 is rotated until apertures 52 and 55 are brought into alignment. Once lock button 80 approaches edge 29, an inward force is applied to lock button 80 causing lock button support 84 to flex and permitting lock button 80 to be moved inwardly through aperture 24 thereby permitting extension 23 to be moved further into internal passage 56. Thereafter, as lock button 80 is brought into alignment with aperture 52, the resilience of button support 84 forces lock button 80 outwardly through aperture 52 and secures extension 23 within internal passage 56. With lock button 80 extending through aperture 52 of angled bar 31, cross member 11 occupies its highest position raising toy articles 36 through 38 (see FIG. 1) to their greatest height. It should be noted that a corresponding attachment takes place between leg member 12 and cross member 11. Thus by the foregoing attachment, cross member 11 is secured to leg members 12 and 13 and provides suspension of toy articles 36 through 38. In accordance with an important aspect of the present invention, the extension of cross member 11 with respect to leg members 12 and 13 may be adjusted by depressing lock button 80 into aperture 52 and again moving extension 23 further into internal passage 56. Such movement eventually brings button 80 into alignment with aperture 53 at which point the resilience of button support 84 forces lock button 80 outwardly through aperture 53 locking cross member 11 to leg member 13 at a lower height. A similar adjustment may take place to cause button 80 to extend into apertures 54 and 55 to further adjust the height of cross member 11. While the above-described adjustment may take place sequentially, it should be noted that a rapid adjustment may be undertaken by simply rotating leg member 13 with respect to cross member 11 once lock button 80 is depressed. When so rotated, apertures 52 and 55 are moved out of alignment with lock button 80 and lock button 80 is maintained in a depressed position by its abutment with the interior of internal passage 56. Thus when so positioned, extension 23 may be simply moved within internal passage 56 until the desired one of apertures 52 through 55 is aligned with button 80 afterwhich rotation of leg member 13 until lock button 80 is aligned with the desired aperture causes the above-described locking action to take place. By similar operation, leg member 13 may be rotated to the closed position shown in FIG. 2 until lock button 80 extends through aperture 51 causing leg member 13 to be locked in the closed position. Once again, it should be recalled that a corresponding attachment is provided between leg member 12 and junction bar 20 of cross member 11.

Figure 4:
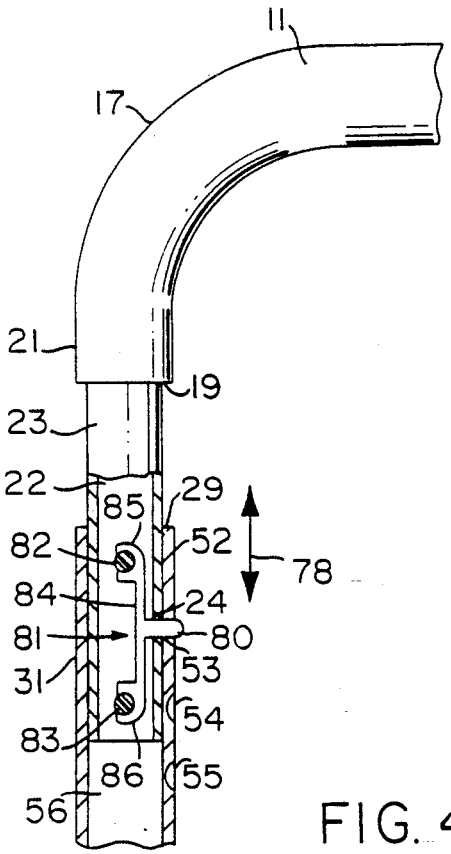
FIG. 4 sets forth a partial section view of the present invention infant toy support taken along section lines 4—4 in FIG. 1.

FIG. 4 sets forth a partial section view of the present invention infant toy support taken along section lines 4—4 in FIG. 1. Cross member 11 includes a bend 17 and a junction bar 21 extending therefrom. Junction bar 21 defines a lip 19 and a reduced dimension extension 23. Extension 23 defines an interior 22 within which a pair of generally cylindrical boss members 82 and 83 extend transversely. Extension 23 further defines an aperture 24. A lock member 81, preferably formed of a resilient material, defines a button support 84 and a pair of clasp members 85 and 86. Clasp members 85 and 86 secure lock member 81 to boss members 82 and 83 such that lock button 80 extends outwardly through aperture 24.

Angled bar 31 defines a generally cylindrical member having an internal passage 56 and a plurality of apertures 52 through 55 positioned in a linear arrangement. Extension 23 is received within internal passage 56 and is attached to angled bar 31 by the extension of lock button 80 through aperture 53. As described above, the relative positions between cross member 11 and angled bar 31 may be adjusted by depressing lock button 80 causing button support 84 to flex and permitting lock button 80 to be moved from aperture 53 afterwhich extension 23 may be moved within internal passage 56 until lock button 80 is aligned with the desired aperture. Once the position of extension 23 aligns lock button 80 with the desired one of apertures 52 through 55, lock button 80 is forced outwardly through the selected aperture by the resilience of button support 84. Once again, it should be recalled that while the attachment of junction bar 21 to angled bar 31 has been shown and described in detail, a corresponding attachment is provided between junction bar 20 and angled bar 30 to support cross member 11 in the manner shown and described above.

What has been shown is an improved infant toy support which provides an increased entertainment value for the infant and an increased measure of safety for its use. The inventive structure shown provides for easy adjustment of the height of the suspended toy articles above the infant as well as the easy closure of the structure to a folded or storage position. In addition, the present invention structure provides angled supports which further enclose the infant beneath the suspended articles and which discourage infant activities which may tend to subject the infant to the danger of injuries.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. For use in supporting a plurality of infant toy articles above an infant, an infant toy support comprising:

an elongated cross member having first and second ends;

a plurality of infant toy attachment means secured to said cross member;

a first leg member having a first base member and a first angled bar joined thereto forming an acute angle therebetween;

a second leg member having a second base member and a second angled bar joined thereto forming an acute angle therebetween;

first lock means securing said first leg member to said first end of said cross member in an adjustable attachment in which said first leg member is detentably positionable with respect to said cross member in a plurality of angular and spacial positions;

second lock means securing said second leg member to said second end of said cross member in an adjustable attachment in which said second leg member is detentably positionable with respect to said cross member in a plurality of angular and spacial positions;

a first angled support defining a first ring member and being secured to said first base member and said first angled bar spanning the acute angle formed therebetween;

a second angled support defining a second ring member and being secured to said second base member and said second angled bar spanning the acute angle formed therebetween; and first and second toy articles supported within said first and second ring members.

2. An infant toy support as set forth in claim 1 wherein said first and second toy articles include generally spherical rattles supported within said first and second ring members.

3. An infant toy support as set forth in claim 1 wherein said first and second ends of said cross member include first and second respective cylindrical extensions and wherein said first and second angled bars define respective first and second cylindrical passages for receiving said first and second cylindrical extensions.

4. An infant toy support as set forth in claim 3 wherein said first and second angled bars define respective first and second pluralities of apertures and wherein said first and second lock means include respective first and second depressible lock buttons which cooperate with said respective first and second pluralities of apertures.

5. An infant toy support as set forht in claim 4 wherein said first and second leg members further include first and second reinforcing webs extending between said respective first and second angled bars and base members.

6. An infant toy support comprising:

an elongated cross member having end portions for supporting a plurality of toy articles;

a pair of acute angled generally V-shaped leg members;

a pair of detentable lock means for attaching said pair of leg members to said end portions of said cross member such that said cross member may be supported by said leg members above a supporting surface in a height-adjustable attachment and such that said leg members may be pivoted to configure said leg members and said cross member in a generally coplanar alternate arrangement;

a pair of rotatable toy article supports extending at acute angles between said leg members spanning their individual acute angles; and a pair of toy articles rotatably supported within said toy article supports.

* * * * *